US008047360B2

(12) United States Patent
Rea et al.

(10) Patent No.: US 8,047,360 B2
(45) **Date of Patent: *Nov. 1, 2011**

(54) SINGLE LOBE FILTER BAG FOR INFUSION PRODUCTS

(75) Inventors: Dario Rea, Monterenzio (IT); Rodolfo Caroli, Imola (IT); Sauro Rivola, Riolo Terme (IT)

(73) Assignee: Ima Flavour S.R.L., Ozzano Emilia (IT)

( * ) Notice: Subject to any disclaimer, the term of this patent is extended or adjusted under 35 U.S.C. 154(b) by 0 days.

This patent is subject to a terminal disclaimer.

(21) Appl. No.: 12/663,786

(22) PCT Filed: May 28, 2008

(86) PCT No.: PCT/IB2008/001546

§ 371 (c)(1),
(2), (4) Date: Dec. 9, 2009

(87) PCT Pub. No.: WO2008/152498

PCT Pub. Date: Dec. 18, 2008

(65) Prior Publication Data

US 2010/0176007 A1 Jul. 15, 2010

(30) Foreign Application Priority Data

Jun. 11, 2007 (IT) ..... BO2007A0408

(51) Int. Cl.
*B65D 85/804* (2006.01)

(52) U.S. Cl. ..... 206/0.5; 383/104; 426/77

(58) Field of Classification Search ..... 206/0.5, 206/524.1; 426/77; 99/279, 323; 383/104, 383/120

See application file for complete search history.

(56) References Cited

U.S. PATENT DOCUMENTS 4,229,481 A * 10/1980 Fornari ..... 426/77
4,659,495 A * 4/1987 Figliola ..... 424/401
5,598,929 A * 2/1997 Jensen et al. ..... 206/527
5,788,061 A * 8/1998 Hammond ..... 206/0.5

(Continued)

FOREIGN PATENT DOCUMENTS

BE 517 130 A 2/1953

(Continued)

*Primary Examiner* — J. Gregory Pickett
*Assistant Examiner* — King M Chu
(74) *Attorney, Agent, or Firm* — Pearne & Gordon LLP

(57) ABSTRACT

A single-lobe filter bag for infusion products comprises: a length (2) of filter material forming a chamber (3) containing a charge of the infusion product; the length (2) comprises a first closed top end (5) formed by a first join (S1) between two first end edges of the length (2); a second bottom end (7) closed by a second join (S2) designed to form a bottom surface (11) of the filter bag (1) and formed by two second end edges (7*a*, 7*b*) placed over each other to form a central extension of the second end (7); the second end edges (7*a*, 7*b*) are positioned face to face with each other and joined in such a way as to form a tab (12) that protrudes from the bottom surface (11); two sides (8, 9) which connect the first end edge (5) and the second end edge (7) and which are at least partly folded onto each other to form a fold towards the inside of the chamber (3); a string (13) joined, at one end, by a knot (A1) to the length (2) and, at the other end, by a knot (A2) to a tag (14), the string (13) being looped around the length (2).

13 Claims, 3 Drawing Sheets

U.S. PATENT DOCUMENTS

| | | | | |
|---|---|---|---|---|
| 5,797,243 | A * | 8/1998 | Tagliaferri et al. | 53/413 |
| 6,409,386 | B1 * | 6/2002 | Trani et al. | 383/120 |
| 6,730,338 | B2 * | 5/2004 | Suzuki | 426/77 |
| 2001/0007688 | A1 * | 7/2001 | Klar | 426/80 |
| 2004/0011678 | A1 * | 1/2004 | Ramet | 206/216 |

FOREIGN PATENT DOCUMENTS

| | | | |
|---|---|---|---|
| DE | 44 27 955 | A1 | 2/1996 |
| EP | 0 101 082 | A1 | 2/1984 |
| EP | 1 016 599 | A1 | 7/2000 |
| GB | 2 053 668 | A | 2/1981 |

* cited by examiner

SINGLE LOBE FILTER BAG FOR INFUSION PRODUCTS

TECHNICAL FIELD

This invention relates to a single-lobe or single-chamber filter bag for infusion products, such as tea, coffee, camomile and the like.

BACKGROUND ART

The current market offers many different kinds of filter bags (or tea bags) for infusing the above mentioned products in water.

The wide range of filter bags currently available is the result of the increasingly widespread use and popularity of filter bags among consumers, both in the home and in public places, which has led to a growing demand, especially from product distributors, for diversification of filter bag designs with a view to obtaining filter bags with improved properties in terms of product containment, ease of exchange with the liquid during infusion, shelf life, ease of final packaging, and so on.

The two main designs currently used are the traditional single-lobe bags (usually with tie string and tag) and the now well-established two-lobe bags (also with tie string and tag, with or without individual overwrapper), whose characteristic feature is the larger surface area in contact with the liquid, which allows optimum extraction of the flavour from the infusion product).

Over the years, both these designs have been made from different types of filter paper, including, more recently, biodegradable products.

Similarly, the methods of closing the bag and simultaneously applying the string and tag (in designs where these are present) have been diversified according to production needs and, in some countries, legislative requirements: for example, the tie string, tag and filter bag may be closed and joined by a metal staple, by gluing, by a heat sealable "accessory stamp", by forming a stitch with the tie string itself or by using an adhesive tag.

All of these have improved the quality of filter bags, the processes used to manufacture them (filter bag making machines) and end user satisfaction.

Continuing its policy of product improvement, however, the Applicant has noticed that current filter bags, especially single-lobe bags (which this invention is concerned with in particular) have inherent shortcomings due to their shape which, precisely because they have a single chamber, tend to lack adequate three-dimensional, or volumetric, properties. The resulting disadvantages are that:

- the product is more constrained within the bag, with less room to expand during infusion, which means poorer quality infusions and longer infusion times;
- flattening causes the surfaces of the filter bags to become misshapen;
- the filter bags are more difficult to pack on account of possible movements during positioning.

Flattening and movement of the filter bags may damage and reduce the overall quality of the product contained.

DISCLOSURE OF THE INVENTION

For this purpose, the Applicant has created a single-lobe filter bag that overcomes the above mentioned disadvantages and whose structure, besides having the well-known features of customary single-lobe filter bags, is such as to provide a configuration that meets market requirements while at the same time improving the overall quality of the infusion and of the filter bag itself. and reducing the cost of producing the bag.

Accordingly, the invention achieves this purpose by providing a single-lobe filter bag, in particular a single-lobe filter bag for infusion products comprising the technical characteristics described in one or more of the appended claims.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which

DETAILED DESCRIPTION OF THE PREFERRED EMBODIMENTS OF THE INVENTION

Figure 1:
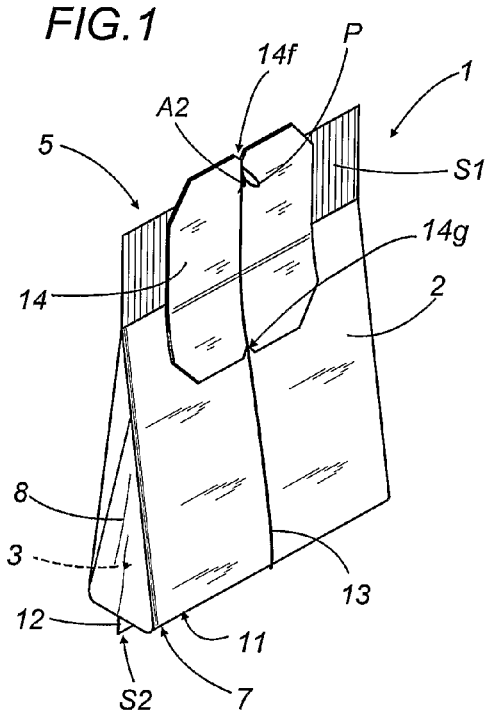
FIGS. 1 to 5 are perspective, front face, side, rear face and top plan views, respectively, illustrating a first embodiment of the single-lobe filter bag for infusion products according to the invention.
Figure 2:
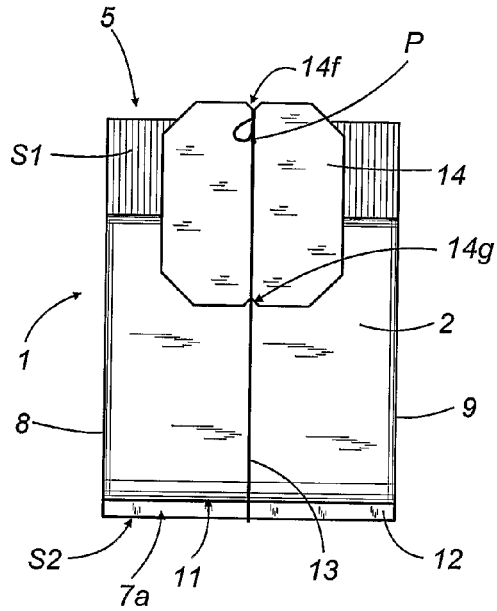
Figure 3:
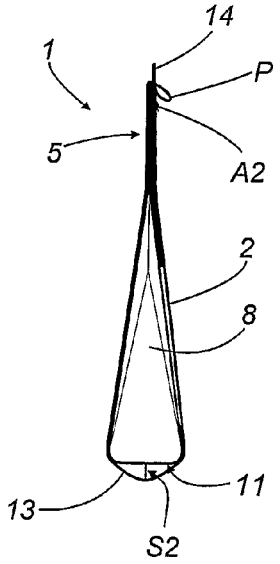
Figure 4:
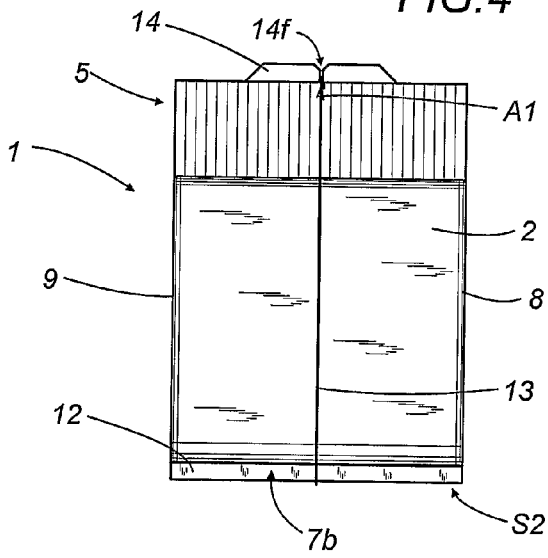
Figure 5:
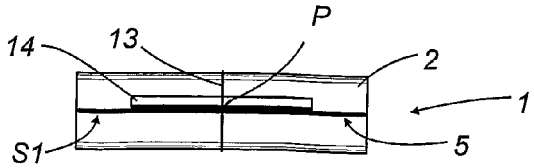
Figure 6:
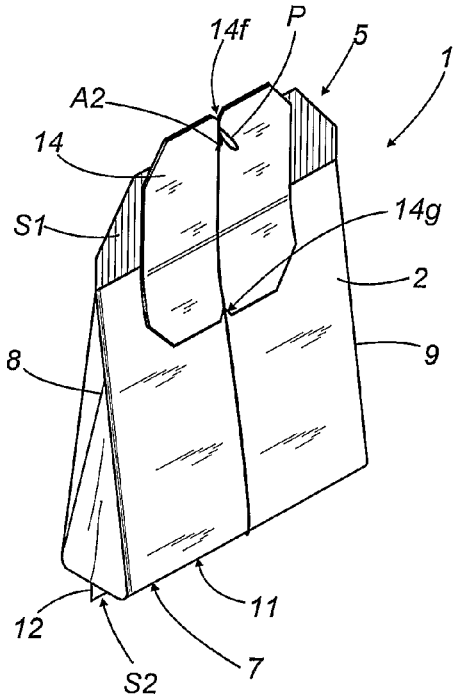
FIGS. 6 to 10 are perspective, front face, rear face, side and top plan views, respectively, illustrating another embodiment of the single-lobe filter bag for infusion products shown in the drawings listed above.
Figure 7:
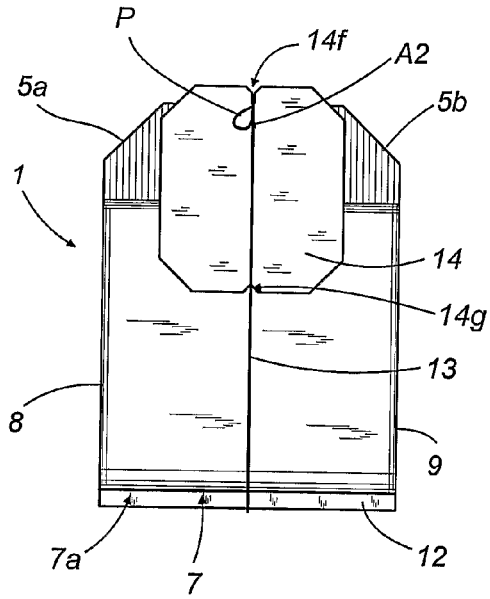
Figure 8:
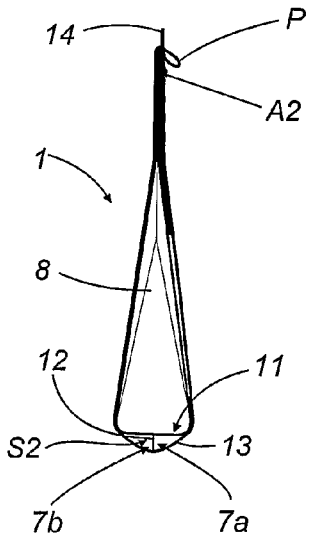
Figure 9:
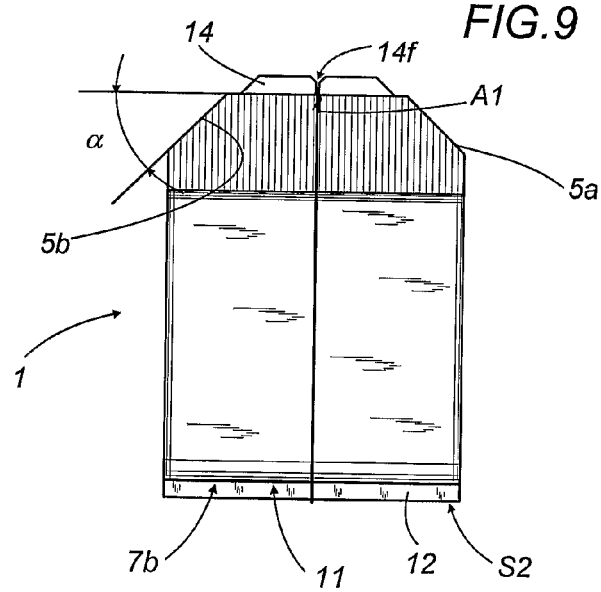
Figure 10:
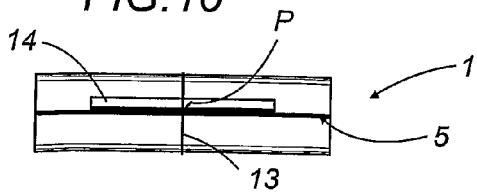

With reference to the accompanying drawings, in particular FIGS. 1 to 10, the single-lobe or single-chamber filter bag is used for infusion products, such as tea, coffee, camomile and the like.

The filter bag, labelled 1 in its entirety, essentially comprises a length 2 of filter material forming a chamber 3 containing a charge (not visible in the drawings) of the infusion product.

The length 2 of filter material has a quadrangular shape defined mainly by: a first, top end 5, a second, bottom end 7 and two sides 8 and 9 for connecting the two ends 5 and 7.

As clearly illustrated in FIGS. 1 to 10, the first, top end 5 is closed and is formed by a first join S1 between two first end edges of the length 2.

The two sides 8 and 9 connecting the first and second ends 5 and 7 of the length 2 are partly folded onto each other to form (in this case) a single fold towards the inside of the chamber 3.

The second, bottom end 7 is closed by a second join S2 designed to form a bottom surface 11, giving the filter bag 1, in cross section, the general shape of a triangle thanks also to the fold of the two sides 8 and 9.

Looking in more detail at FIGS. 2 to 4 and 7 to 9, the second, bottom end 7 is formed by a join S2 made on two second edges 7*a*. and 7*b*. forming a central extension of the second, bottom end 7. The second edges 7*a*. and 7*b*. are folded face to face onto each other and joined in such a way as to form a tab 12 protruding from the bottom base 11.

Figure 11:
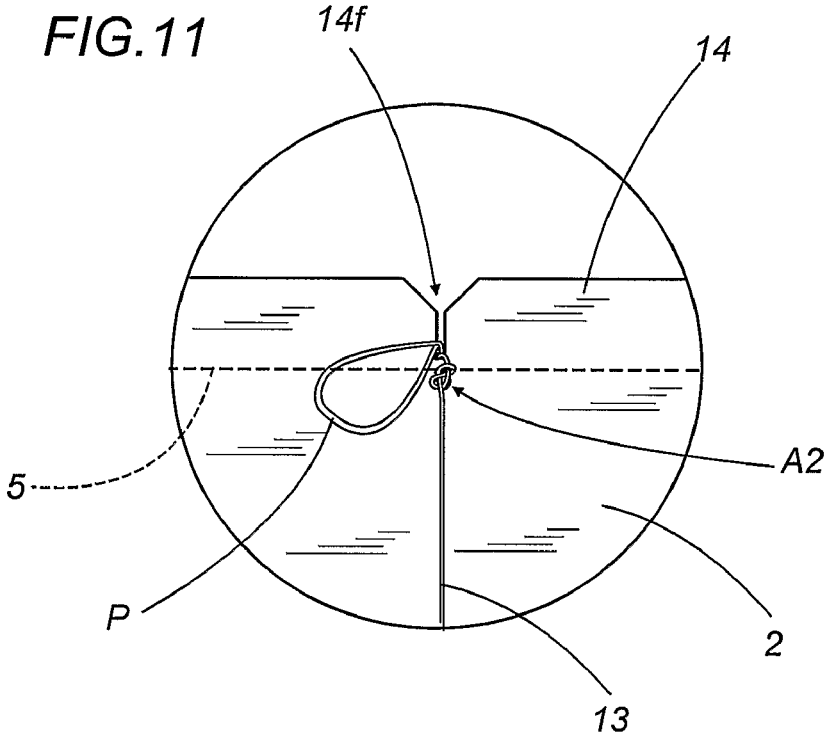
FIG. 11 is a scaled-up detail from FIG. 2.
Figure 12:
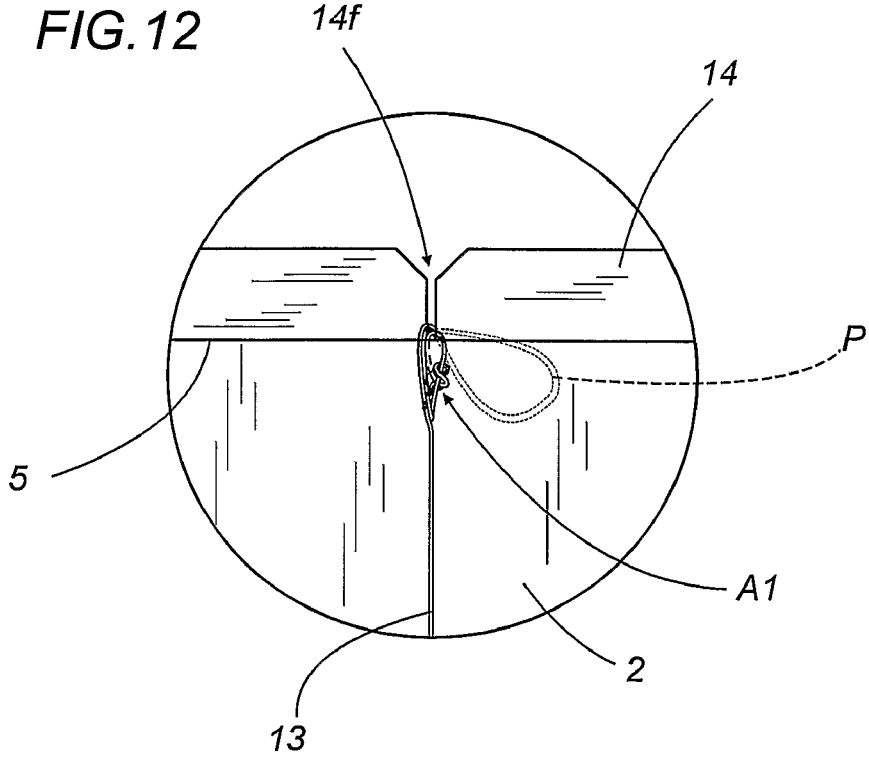
FIG. 12 is a scaled-up detail from FIG. 4.

In addition to the above, the length 2 of filter material that forms the filter bag 1 (see FIGS. 11 and 12) is provided with a string 13 joined, at one end, to the length 2 itself by a knot A1 and, at the other end, to a tag 14 by a knot A2, the string 13 being looped around the length 2 and also around the tab 12 (which can adapt elastically to the string 13 itself) protruding from the bottom base 11.

The tag 14 may also be removably attached, for example by sealing, to the length 2 of filter material where this is necessary to stabilize it.

In all cases, however, to keep the tag 14 in position on the length 2, the tag 14 may have a slit 14*f*. made at the top of it for engaging an end portion P of the string 13 knotted to the length 2 of filter material in such a way as to hold it against the length 2.

In both solutions, that is to say, supported by the string 13 or attached to the length 2, the tag 14 is positioned at the top 5 of the length 2 (where the closing seal S1 is located) and protrudes partially from the length 2 itself, while the rest of it remains in contact with a front surface of the tubular length of film 2.

Further, on the side of it opposite the slit 14*f*, the tag 14 may have a central indentation 14*g*. for stably accommodating the string 13 passing over the tag 14 and in such a way as to prevent the string 13 from moving out of position.

The filter bag 1 illustrated in FIGS. 6 to 10 differs mainly in that the corners 5*a*. and 5*b*. of the first, top end 5 of the length 2 are bevelled symmetrically according to an angle α.

As regards other manufacturing aspects of the filter bag 1, the length 2 of filter material may consist of filter paper or biodegradable material (such as, by way of non limiting example, maize starch) or a non-biodegradable plastic material (such as polyethylene).

The joins on the length 2 of filter material may consist of a first and a second heat seal S1 and S2, that is to say, made by heat sealing.

Alternatively, the two joins may consist of a first and a second seal S1 and S2 made using a suitable glue.

In yet another alternative, the two joins on the length 2 may consist of a first and a second ultrasound seal S1 and S2.

A filter bag made as described above therefore achieves the above mentioned purposes thanks to the special forms imparted to the connecting sides and to the bottom edges that close the length of filter material in such a way as to provide a chamber with a constant volume not only before use, housing the product comfortably and stably, but also during infusion, allowing the product to move and expand optimally within the chamber, thus guaranteeing an infusion of excellent quality and reduced infusion times.

This is accomplished while maintaining the costs of filter bag production at a very low level and the quality of production at a high level.

The invention described above is susceptible of industrial application and may be modified and adapted in several ways without thereby departing from the scope of the inventive concept. Moreover, all the details of the invention may be substituted by technically equivalent elements.

The invention claimed is:

1. A single-lobe filter bag for infusion products comprising:

a length (2) of filter material forming a chamber (3) containing a charge of the infusion product; the length (2) comprising at least a first closed top end (5) formed by a first join (S1) between two first end edges of the length (2) and a second bottom end (7) closed by a second join (S2) adjacent a bottom surface (11) of the filter bag (1), the second end (7) being formed by two second end edges (7*a*, 7*b*) placed over each other to form a central extension of the second end (7); the second end edges (7*a*, 7*b*) being positioned face to face with each other and joined in such a way as to form a tab (12) that protrudes from the bottom surface (11);

a first side (8) and a second side (9), each side connecting the first end edge (5) and the second end edge (7) of the length (2), each side being at least partly folded to form a fold towards the inside of the chamber (3), each side having a top, a middle, and a bottom, the width of the first side near the bottom being, prior to infusion, greater than the width of the first side at its middle, the width of the second side near the bottom being, prior to infusion, greater than the width of the second side at its middle;

a string (13) joined, at one end, by a knot (A1) to the length (2) and, at the other end, by a knot (A2) to a tag (14), the string (13) being looped around the length (2).

2. The filter bag according to claim 1, characterized in that the length (2) of filter material is made from filter paper.

3. The filter bag according to claim 1, characterized in that the length (2) of filter material is made from a biodegradable material.

4. The filter bag according to claim 1, characterized in that the length (2) of filter material is made from a plastic material.

5. The filter bag according to claim 1, characterized in that the joins on the length (2) of filter material comprise a first heat seal (S1) and a second heat seal (S2).

6. The filter bag according to claim 1, characterized in that the joins on the length (2) of filter material comprise a first glued seal (S1) and a second glued seal (S2).

7. The filter bag according to claim 1, characterized in that the joins on the length (2) of filter material comprise a first ultrasound seal (S1) and a second ultrasound seal (S2).

8. The filter bag according to claim 1, characterized in that corners (5*a*, 5*b*) of the first, top end (5) of the length of filter material are bevelled symmetrically according to an angle (α).

9. The filter bag according to claim 1, characterized in that the tag (14) is also removably associated with the length (2) of filter material.

10. The filter bag according to claim 1, characterized in that the tag (14) has a slit (14*f*) at a top of the tag designed to be engaged by an end portion (P) of the string (13) knotted to the length (2) of filter material in such a way to hold the tag in contact with a front surface of the length (2).

11. The filter bag according to claim 1, characterized in that the tag (14) is positioned in such a way that an upper portion of it protrudes from the top end (5) of the length of filter material (2).

12. The filter bag according to claim 10, characterized in that the tag (14), on a side of it opposite the slit (14*f*), has a central indentation (14*g*) for stably accommodating the string (13) passing over the tag (14) and in such a way as to prevent the string (13) from moving out of position.

13. The filter bag according to claim 1, wherein the bag has a vertical cross section defined by a vertical plane between the first side and the second side and parallel to the first side, the cross section having a general shape of a triangle with one side of the triangle outlining the bottom surface (11) and the other two sides of the triangle angling upwards towards the first join (S1).

* * * * *